US005496090A

United States Patent [19]

Emmett et al.

[11] Patent Number: 5,496,090

[45] Date of Patent: Mar. 5, 1996

[54] HAIRCUT WORK STATION

[75] Inventors: Frank E. Emmett, Penngrove; Greg Luzaich, Windsor, both of Calif.

[73] Assignee: Frank E. Emmett, Inc., Penngrove, Calif.

[21] Appl. No.: 294,955

[22] Filed: Aug. 24, 1994

[51] Int. Cl.[6] ..... A47C 15/00

[52] U.S. Cl. ..... 297/240; 297/241

[58] Field of Search ..... 297/240, 241, 297/232, 257, 15; 108/26

[56] References Cited

U.S. PATENT DOCUMENTS

| | | | |
|---|---|---|---|
| 689,964 | 12/1901 | Hieber . | |
| 1,686,464 | 8/1927 | Perry . | |
| 1,773,504 | 8/1930 | Stokes . | |
| 2,087,932 | 7/1937 | Zola . | |
| 2,252,137 | 8/1938 | Rummerfield . | |
| 2,445,240 | 7/1948 | Paden . | |
| 2,446,376 | 8/1948 | Littlejohn . | |
| 2,449,385 | 9/1948 | Johnson . | |
| 2,498,550 | 2/1950 | Johnson et al. . | |
| 2,553,545 | 5/1951 | Booth . | |
| 2,565,595 | 5/1951 | Cooper . | |
| 2,572,874 | 10/1951 | MacKnight . | |
| 2,578,373 | 12/1951 | Powell . | |
| 2,602,485 | 7/1952 | Alloway . | |
| 2,969,108 | 1/1961 | MacKnight . | |
| 3,066,979 | 12/1962 | Pitts et al. | 297/240 |
| 4,815,785 | 3/1989 | Goodall et al. | 297/241 X |
| 4,863,217 | 9/1989 | Fountain . | |

*Primary Examiner*—Laurie K. Cranmer
*Attorney, Agent, or Firm*—Larry D. Johnson

[57] ABSTRACT

A haircut work station provides a customer chair and a complementary operator seat which is movable in a generally circular arc about the customer chair. The operator seat is supported by a support member upon a swinging arm extending radially outward from a below-floor center post. The operator seat support member penetrates the floor through a narrow, semi-circular travel arc slot about the customer chair. The operator seat may move in and out relative to the customer chair, and may rotate about its own vertical axis. A lift assembly enables vertical movement of the operator seat relative to the floor and customer chair, A frame may be used to connect the center post, lift assembly, and floor. A vacuum line may extend through the customer chair support member to a remote vacuum system.

13 Claims, 3 Drawing Sheets

HAIRCUT WORK STATION

BACKGROUND OF THE INVENTION

1. Field of the Invention

This invention relates generally to chairs and other support structures, and more specifically to an improved barber or hair stylist's work station having a customer chair and a complementary operator seat.

2. Description of the Prior Art

Barber and hair stylist work stations typically provide a customer chair for use by the client whose hair is being cut. Some haircut work stations additionally provide an operator stool or seat for use by the hair stylist. Most of the known prior art customer chair/operator seat combinations provide an operator seat which simply revolves through all or part of a circular path about the customer chair. The mechanism for this revolution is above ground (above floor level), and generally consists of some type of telescoping tube or sliding arm arrangement connected to the support post for the customer chair.

However, this sort of structural arrangement may obstruct the hair stylist when he or she is moving or walking about the customer chair. In the case of hair cutting, the chances of a hair stylist sitting one hundred percent of the time when cutting the customer's hair are remote. Since this is true, the design of the customer chair and operator seat should be such that the operator seat support arm never gets in the way of the hair stylist. The performance of the prior art work stations is thus negatively impacted by the use of an above ground support arm for the operator seat.

SUMMARY OF THE INVENTION

The haircut work station of this invention provides an improved barber or hair stylist's work station having a customer chair and a complementary operator seat which is movable in a generally circular arc about the customer chair. The inventive apparatus includes the customer chair supported by its customer chair support member upon a floor-level deck plate, and the operator seat supported by its operator seat support member upon a swinging arm extending radially outward from a below-floor center post. The operator seat support member penetrates the floor-level deck plate through a narrow, generally circular travel arc slot about the customer chair. A lift assembly which may be in the form of a linear actuator, lift arm and carriage is linked to the swing arm to enable vertical movement of the swing arm (and, therefore, the operator seat) relative to the deck plate and customer chair. A guide arm to stabilize the operator seat may extend between the center post and the operator seat support member, with a guide member and guide rollers slidably engaging the operator seat support member. A frame may be used to support the floor structure and connect the center post, lift assembly, and deck plate, and may render the overall work station apparatus modular in nature for efficiency in construction and in-floor installation. Finally, a vacuum line may extend through the customer chair support member to a remote vacuum system.

This inventive haircut work station design has several unique features with respect to the prior art. The first is the below-floor operator seat support mechanism design, which significantly improves the performance and ergonomics of the system. This design allows a clear floor when the seat is not in use, so the hair stylist may easily walk around the customer.

The operator seat used by the hair stylist is enabled to move relative to the customer chair in several ways:

1. Circular, revolving movement (described supra) of the operator seat is in a range of approximately 270 degrees relative to the customer chair, which is a greater range than many of the systems disclosed in the prior art. This circular movement may be manual (with the stylist sitting on the operator seat using his or her legs to push or pull the seat about the customer chair), or it may be motorized.
2. Vertical movement of the operator seat relative to the customer chair is enabled by movement of the electric linear actuator based lift mechanism. Actuation of the lift mechanism is accomplished by either of two electric switches located on the head of the hair clipper and on the back of the customer chair. This moves the entire operator seat assembly up and down through a range of approximately eleven inches. Vertical movement of the operator seat relative to the customer chair may be supplemented by incorporation of a gas spring which allows the hair stylist to further adjust the range of vertical travel tailored to their individual preference. This is accomplished by actuating a handle directly under the operator seat.
3. In-out movement of the operator seat relative to the customer chair is accomplished by the use of a linear bearing slide on top of the operator seat support member. This allows for movement of the operator seat when loaded (when the hair stylist is sitting or otherwise resting upon the seat) and without frictional drag. The linear bearing slide is preferably spring-loaded to return to center when not in use.
4. Angular (pitch) movement of the operator seat relative to the customer chair is adjustable through the use of a tilt mechanism, again located beneath the operator seat and on top of the operator seat support member. This allows the hair stylist to quickly adjust the operator seat to an angular position which is comfortable, thus reducing back strain and overall fatigue.
5. Finally, rotational movement of the operator seat may be enabled by inclusion of a swivel or pivot mechanism beneath the seat for rotation about the support member vertical axis, if desired. This rotational movement may be biased to return to center via a spring loading mechanism.

The customer chair is preferably stationary, while the hair stylist moves up or down, in or out and around the customer chair on the electrically-operated operator seat which, in the current configuration, is attached to the customer chair by a below-floor cantilevered swivel-arm. The customer chair may alternatively be constructed so that it may rotate, adjust vertically, tilt, and the like, without affecting the function of the invention. Holsters for the hair clipper and other equipment are preferably attached to the back of the customer chair, within easy reach of the hair stylist. The clipper holder is preferably a "tear-away" type which will protect the unit from damage.

While use of the operator seat is not mandatory, but rather at the hair stylist's option, it does promote accuracy as it allows the hair stylist to rest easily at eye level with the hair-section they are cutting. Working at eye level affords that perspective in the general field of vision which is imperative for accurate results.

The result is a quiet, smooth, and efficient performance. The customer chair, operator seat and attachments promote a high-tech shop decor but, more importantly, they permit functional precision during continuous and repetitive operations. The hair stylist's seated position and ease of movement into and out of the seat conveys an attitude of drafting-table precision, an attitude redolent of high-energy, accuracy and intricacy.

DETAILED DESCRIPTION OF A PREFERRED EMBODIMENT

Figure 1:
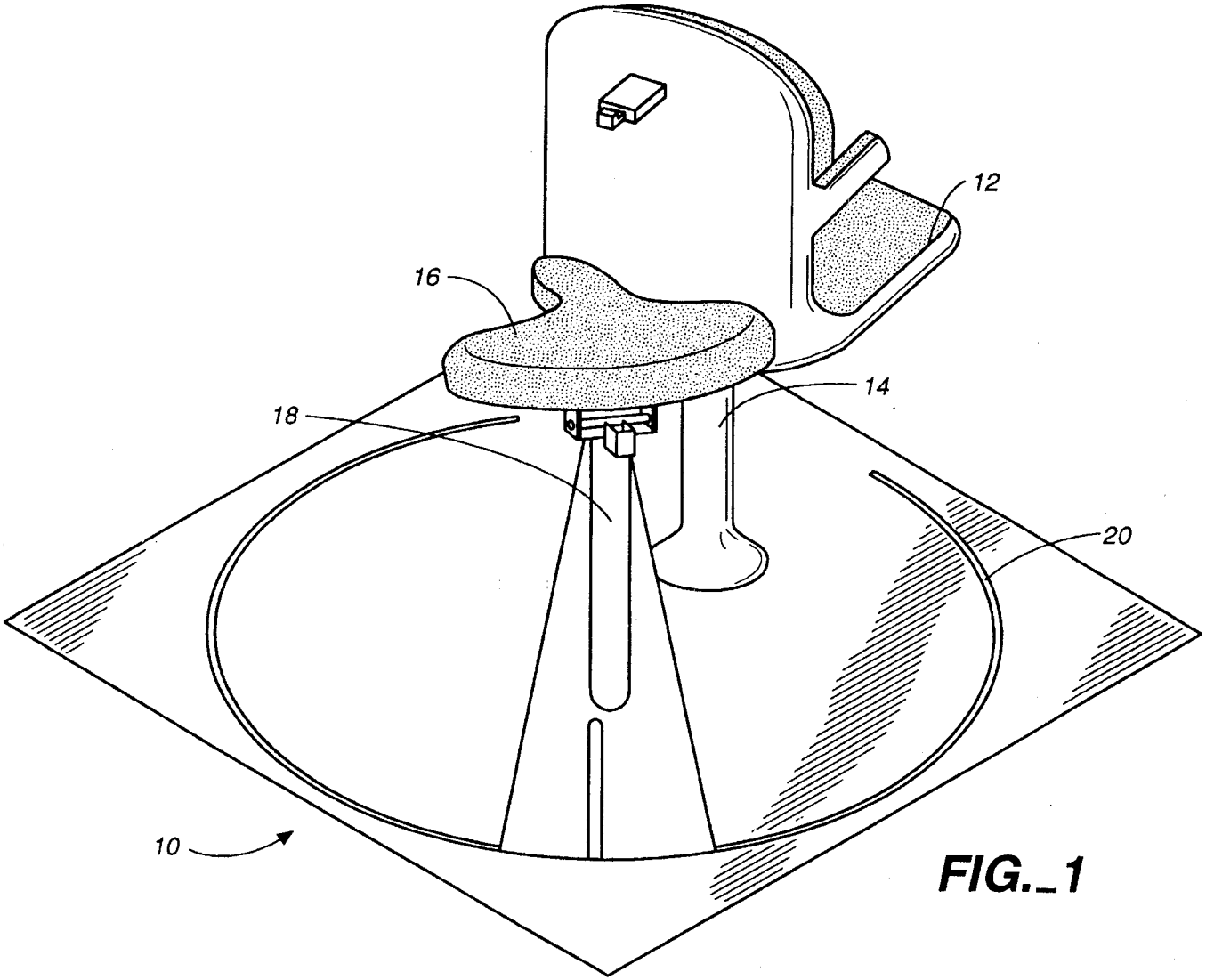
FIG. 1 is a perspective view of a haircut work station of this invention, illustrating a customer chair on its customer chair support member, and a complementary operator seat on its operator seat support member, this view further illustrating the generally circular travel arc slot for the operator seat support member to revolve about the customer chair.

FIG. 1 is a perspective view of a haircut work station 10 of this invention, illustrating a customer chair 12 on its customer chair support member 14, and a complementary operator seat 16 on its operator seat support member 18. This view further illustrates the generally circular (approximately 270 degrees) travel arc slot 20 for the operator seat support member 18 to revolve about the customer chair 12.

Figure 2:
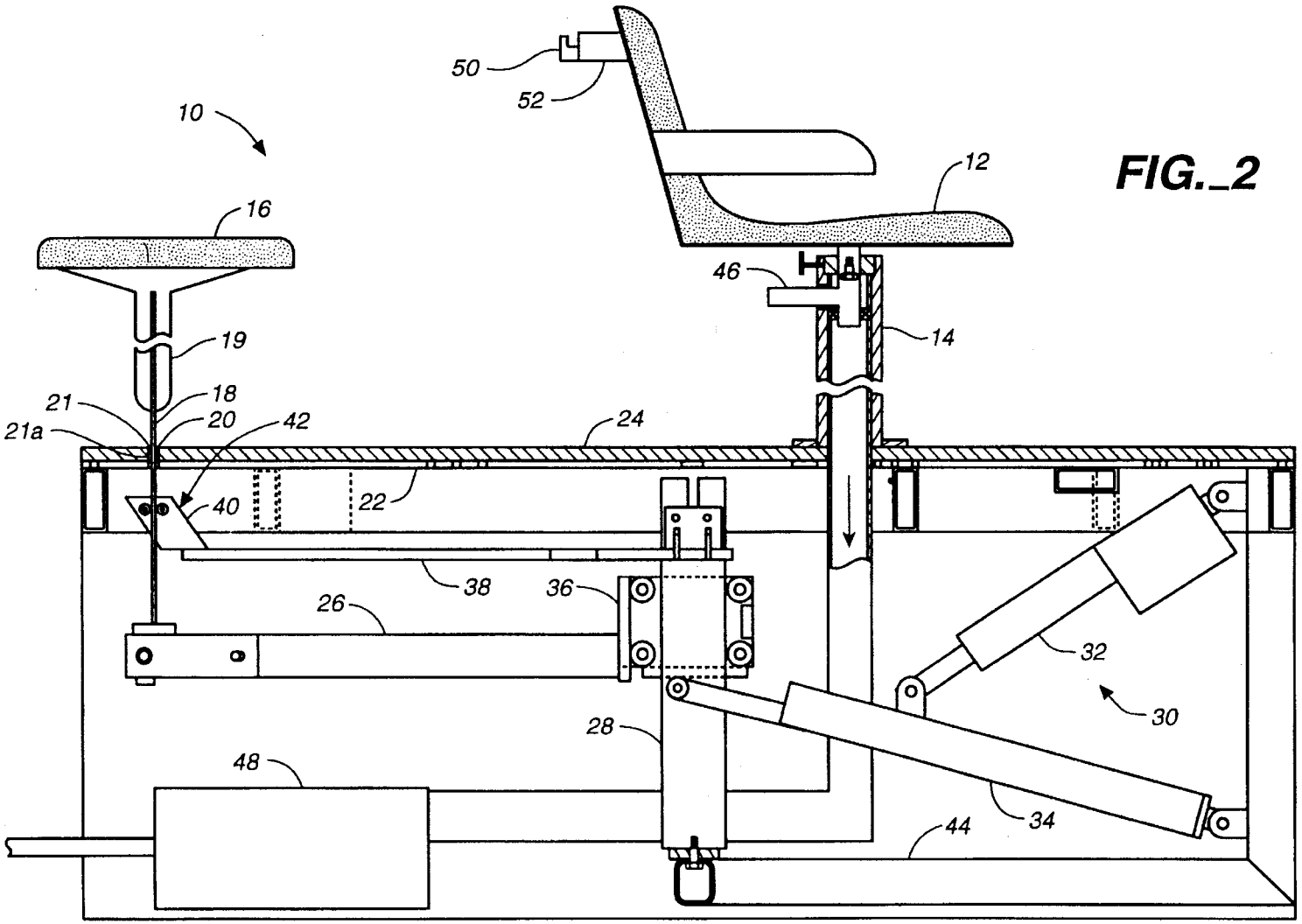
FIG. 2 is a schematic side elevation view in partial cross-section the haircut work station of this invention, illustrating the operative components including the customer chair supported by its customer chair support member upon a floor-level deck plate, the operator seat supported by its operator seat support member upon a swinging arm extending radially outward from a below-floor center post, a lift assembly in the form of a linear actuator, lift arm and carriage linked to the swing arm to enable vertical movement (and simultaneous circular movement) of the operator seat relative to the deck plate and customer chair, a guide arm extending between the center post and the operator seat support member, with a guide member and guide rollers slidably engaging the operator seat support member, a frame connecting the center post, lift assembly, and deck plate, and a vacuum line extending through the customer chair support member to a remote vacuum system.

FIG. 2 is a schematic side elevation view in partial cross-section of the haircut work station 10 of this invention, illustrating the operative components including the customer chair 12 supported by its customer chair support member 14 upon a floor or floor-level steel deck plate 22. Anti-fatigue mat 24 may overlay deck plate 22. Travel arc slot 20 extends through both deck plate 22 and mat 24, and may be lined on both sides with a UHMW (ultra high molecular weight) or other low friction material liner 21, which may include a low friction material dust seal 21a to serve as a barrier to hair clippings and other debris.

The operator seat 16 is supported by its operator seat support member 18, which is desirably narrow in radial cross-section (in the direction of the swing arm). This enables slot 20 to be kept as narrow as possible, preventing the slot from being a surface hazard (e.g., catching a shoe heel), or from collecting debris. The support member 18 may include a more substantial (and larger) structural support tube 19, proximate the seat and above the desirably narrow portion of the support member that must penetrate the travel arc slot 20.

Operator seat support member 18 is connected to and rests upon a swinging arm 26 extending radially outward from a below-floor pivoting center post 28, which represents the center of revolution of the operator seat 16 about the customer chair 12. A lift assembly 30 in the form of a linear actuator 32, lift arm 34 and carriage 36 is linked to the swing arm 26 to enable vertical movement of the swing arm 26, and therefore the operator seat 16, relative to the deck plate 22 and customer chair 12. Alternatively, another form of lifting apparatus may be utilized, such as a hydraulic lift or geared motor. Bearings on the end of lift arm 34 enable simultaneous vertical and circular movement of the operator seat.

A guide arm 38 extends between the center post 28 and the operator seat support member 18, with a guide member 40 and guide rollers 42 slidably engaging the operator seat support member 18 at a point close to the deck plate groove, thus reducing deflection and groove friction. Since support member 18 is preferably thin in cross-section, it tends to deflect under high moment loads. These moment loads are created when the seat is slid forward. The guide arm reduces the deflection to a minimum thus reducing drag on the system during rotation.

A frame 44 structurally connects the center post 28, lift assembly 30, and deck plate 22. A vacuum line 46 extends through the customer chair support member 14 to a remote vacuum system 48. This vacuum line may include a spring-biased connection beneath the customer chair to urge the vacuum line to one side or the other of the hair stylist. A tear-away clipper holder 50 for a vacuum-type hair clipper (not illustrated) may be incorporated into the back of the customer chair 12, along with a system control panel 52 for operating the lift assembly, inter alia.

Figure 3:
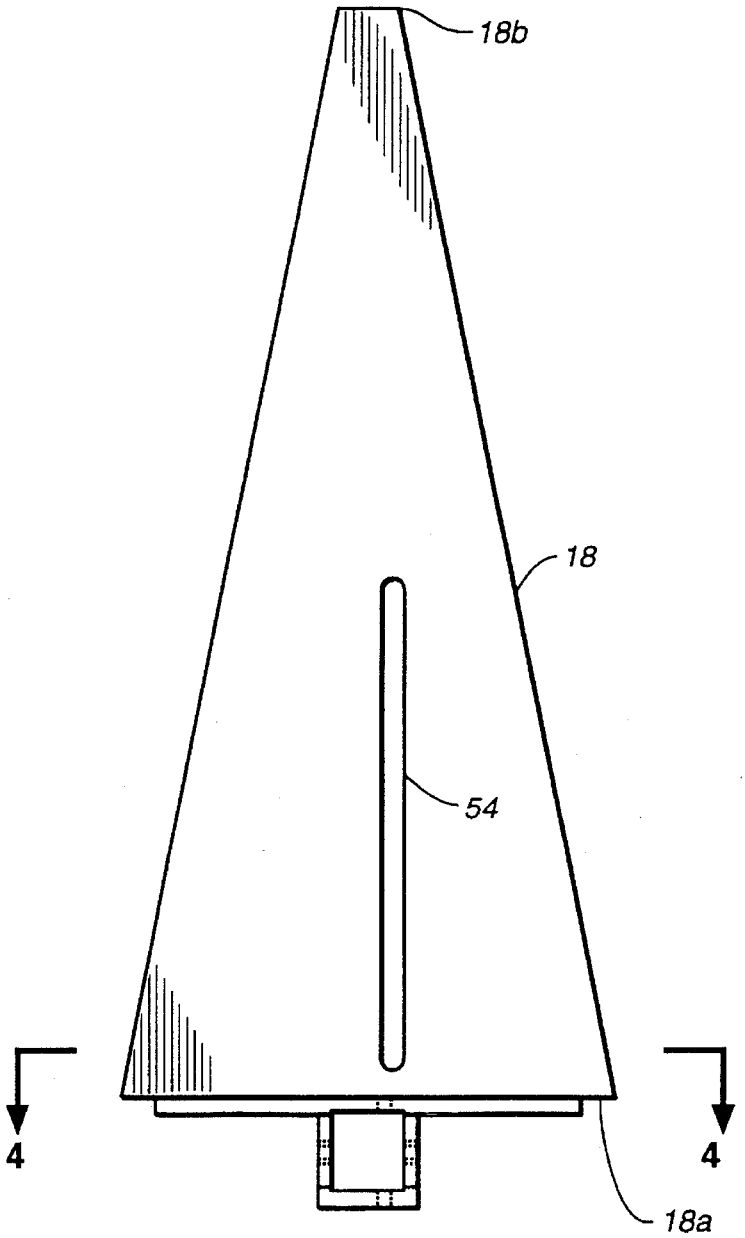
FIG. 3 is a side elevation view of the operator seat support member of the haircut work station of this invention, illustrating a guide aperture.

FIG. 3 is a side elevation view of the operator seat support member 18 of the haircut work station of this invention, illustrating a guide aperture 54 enabling passage of guide member 40 (FIG. 2). Support member 18 is preferably generally triangular in lateral cross-section, as illustrated, for aesthetic purposes as well as to provide desired strength near its base 18*a*, and desired compactness near its top 18*b* adjacent the operator seat.

Figure 4:
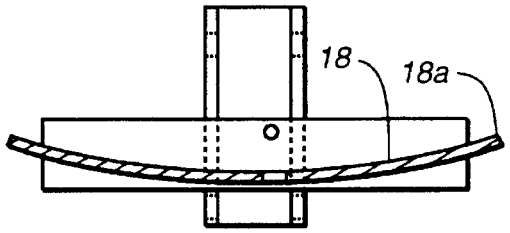
FIG. 4 is a top plan cross-sectional view of the operator seat support member, illustrating its generally arcuate shape to conform with the semi-circular travel arc slot, this view taken along line 4—4 of FIG. 3, proximate the base of the support member.

FIG. 4 is a top plan cross-sectional view of the operator seat support member 18, illustrating its generally arcuate shape to conform with the generally circular shape of the travel arc slot 20 (FIG. 1), this view taken along line 4—4 of FIG. 3, proximate the base 18*a* of the support member. This shape also provides strength due to a higher moment of inertia.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A haircut work station comprising:

a customer chair supported by a customer chair support member upon a floor-level deck plate bearing a generally circular travel arc slot about said customer chair;

an operator seat supported by an operator seat support member upon a swinging arm extending radially outward from a below-floor center post, said operator seat support member penetrating said floor-level deck plate through said generally circular travel arc slot;

a lift assembly linked to said swinging arm to enable simultaneous circular and vertical movement of said swing arm and said operator seat relative to said floor-level deck plate and said customer chair.

2. The haircut work station of claim 1 further including a guide arm extending between said center post and said operator seat support member.

3. The haircut work station of claim 2 wherein said guide arm includes a guide member and guide rollers slidably engaging said operator seat support member.

4. The haircut work station of claim 1 further including a frame portion to connect said center post, lift assembly, and floor-level deck plate.

5. The haircut work station of claim 1 further including a vacuum line extending through said customer chair support member to a remote vacuum system.

6. The haircut work station of claim 1 wherein said lift assembly comprises a linear actuator, lift arm and carriage linked to said swinging arm.

7. The haircut work station of claim 1 wherein said generally circular travel arc slot extends through approximately 270 degrees of arc.

8. The haircut work station of claim 1 wherein said floor-level deck plate includes an anti-fatigue mat.

9. The haircut work station of claim 1 wherein said travel arc slot is lined with a low friction material liner.

10. The haircut work station of claim 9 wherein said travel arc slot liner includes a low friction material dust seal.

11. The haircut work station of claim 1 wherein said operator seat support member includes a structural support tube proximate said operator seat.

12. The haircut work station of claim 1 wherein said operator seat support member is generally triangular in lateral cross-section.

13. The haircut work station of claim 1 wherein said operator seat support member is generally arcuate in shape to conform with the shape of said travel arc slot.

* * * * *